US008365646B2

(12) United States Patent
Fields

(10) Patent No.: US 8,365,646 B2
(45) Date of Patent: Feb. 5, 2013

(54) SECURING DEVICE

(76) Inventor: Thomas W. Fields, Wadsworth, OH (US)

( * ) Notice: Subject to any disclaimer, the term of this patent is extended or adjusted under 35 U.S.C. 154(b) by 134 days.

(21) Appl. No.: 12/993,740

(22) PCT Filed: Jul. 17, 2009

(86) PCT No.: PCT/US2009/050926

§ 371 (c)(1),
(2), (4) Date: Nov. 19, 2010

(87) PCT Pub. No.: WO2010/009360

PCT Pub. Date: Jan. 21, 2010

(65) Prior Publication Data

US 2011/0061519 A1 Mar. 17, 2011

Related U.S. Application Data

(60) Provisional application No. 61/081,858, filed on Jul. 18, 2008.

(51) Int. Cl.
*D04C 1/02* (2006.01)
*D04C 1/06* (2006.01)

(52) U.S. Cl. ..... 87/2; 87/6

(58) Field of Classification Search ..... 87/2, 6, 87/13; 57/210, 238, 244
See application file for complete search history.

(56) References Cited

U.S. PATENT DOCUMENTS

| | | | | |
|---|---|---|---|---|
| 2,441,209 | A | 5/1948 | Rose | |
| 3,888,965 | A | 6/1975 | Kwolek | |
| 3,968,725 | A * | 7/1976 | Holzhauer | 87/6 |
| 4,001,367 | A | 1/1977 | Guthrie et al. | |
| 4,321,854 | A * | 3/1982 | Foote et al. | 87/6 |
| 4,446,944 | A | 5/1984 | Forrest et al. | |
| 4,563,869 | A | 1/1986 | Stanton | |
| 7,461,500 | B2 * | 12/2008 | Theis | 57/238 |
| 7,703,372 | B1 * | 4/2010 | Shakespeare | 87/6 |
| 2003/0197303 | A1 | 10/2003 | Chuah et al. | |
| 2008/0028740 | A1 | 2/2008 | Ushijima | |
| 2010/0162882 | A1 * | 7/2010 | Shakespeare | 87/6 |
| 2011/0239420 | A1 * | 10/2011 | Abell | 24/712 |

* cited by examiner

*Primary Examiner* — Shaun R Hurley
(74) *Attorney, Agent, or Firm* — Christopher L. Parmelee; Walker & Jocke

(57) ABSTRACT

A securing device is provided comprised of a reactive fiber component and at least one of a terminating fiber component and an initiating fiber component. The reactive fiber component includes at least one of the following: an undrawn polymer fiber and a substantially undrawn polymer fiber, wherein the first reactive fiber component is operative to stretch responsive to a load. The terminating fiber component is in a compressed state and is operative to elongate to a length at which the terminating fiber component is operative to prevent further stretching of the first reactive fiber component responsive to the load. The initiating fiber component is operative to break responsive to a predetermined force and permit the first reactive fiber component to stretch responsive to the load.

20 Claims, 5 Drawing Sheets

SECURING DEVICE

TECHNICAL FIELD

An embodiment of at least one invention described herein relates to securing devices capable of safely absorbing and dissipating energy associated with a load such as a falling object or person.

BACKGROUND

Securing devices such as ropes and lines are often used to secure objects and people from moving or falling. Examples include lines for mooring ships and safety ropes used by mountain climbers and construction workers. Securing devices in the form of sheets and nets may also be used to stop falling or moving objects and people. In each of these cases, the object or person may exert high forces on the securing device, which cause the securing device to break prematurely and/or cause harm to the object or person being secured. For example, lash back from a broken mooring line can harm a person near the broken line. Also, the sudden stopping forces acting on a falling person or object caused via a rope, line or net can injure the person or object being secured. Thus there exists a need for securing devices which offer greater safety protection to the persons and objects associated with or near the securing devices.

BRIEF SUMMARY

It is an object of an example embodiment of at least one invention to provide a securing device.

It is a further object of an example embodiment of at least one invention to provide a securing device which provides greater safety to objects and persons associated with and/or near the safety device.

Further objects of example embodiments will be made apparent in the following Detailed Description and in the appended claims.

The foregoing objects may be accomplished in new securing device that is capable of being used as and/or integrated into ropes, lines, nets, lanyards, sheets or other devices that can be used to secure objects and people and accomplish the absorption and dissipation of energy.

In an example embodiment, the securing device is capable of elongating and dissipating energy in a load with predetermined characteristics applicable to the intended use of the securing device. Example embodiments of the securing device may be comprised of a plurality of components. The plurality of components may include at least one reactive fiber component comprised of a stretchable non-elastic polymer fiber capable of dissipating kinetic energy in a load as the fiber stretches.

The plurality of components may also include an initiating fiber component that breaks under a predetermined amount of force prior to allowing the reactive fiber component to substantially elongate. For example, depending on the intended use of the securing device (e.g., a mooring line), at the predetermined level of force, the initiating fiber may be adapted to break and allow the reactive fiber to stretch and minimize lash back. An initiating fiber component may also be used in a securing device to prevent the securing device from prematurely stretching.

In addition, the securing device may be comprised of at least one terminating fiber component that is operative to initially elongate without substantially dissipating kinetic energy in the load while the reactive fiber component stretches. However, at a predetermined increase in length of the securing device, the terminating fiber component may operate to prevent further elongation of the securing device and to dissipate any remaining kinetic energy in the load (e.g., bringing a falling object to a stopping point).

In addition, the securing device may be comprised of a filler material operative to minimize binding or tangling of the reactive fiber component and the terminating fiber component during elongation of the securing device.

DETAILED DESCRIPTION

Figure 34:
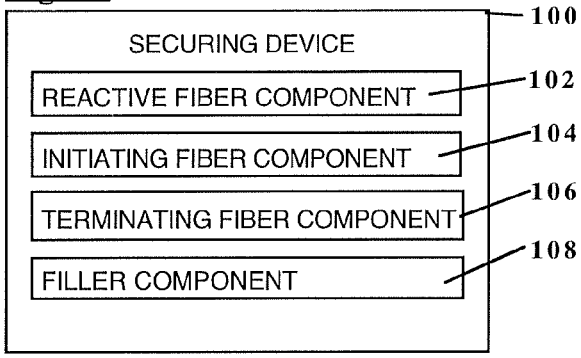
FIG. 34 illustrates a schematic view of an example embodiment of a securing device.

Referring now to the drawings and particularly to FIG. 34, there is shown therein a schematic view of an example embodiment of a securing device 100. Examples of securing devices include ropes, lines, nets, lanyards and other devices that can be used to secure objects and persons. Embodiments of the securing device 100 described herein are capable of stretching under load and dissipating energy in the load over a period of time as the securing device elongates. An example of a load may include a falling person or object secured via an embodiment of the described securing device in the form of a safety rope, loop, or lanyard. An example of a load may also include a moored ship secured to a dock via an alternative embodiment of the described securing device in the form of a mooring loop. An example of a load may also include a flying or moving object that is captured by an alternative embodiment of the described securing device in the form of a composite reinforced material, net, and/or fabric. In general, example embodiments of securing devices may be used to safely reduce kinetic energy in an object or person and/or safely dissipate built up potential energy in the device.

Example embodiments of securing devices described herein may be used in applications associated with fall protection, mountain climbing equipment, parachute shrouds, seat belts, safety harnesses, cargo restraining systems, military personnel drops, safety seating for military aircraft, safety barriers for sporting events, lifting systems, mooring systems or any other application in which there is a need for a device that resists, slows and/or stops movement of objects and people.

In example embodiments, the securing device 100 may be comprised of at least one reactive fiber component 102 capable of stretching under load and dissipating kinetic energy in the load as the reactive fiber is stretched. In an example embodiment, the reactive fiber component is comprised of a stretchable non-elastic synthetic polymer fiber. Examples of stretchable fibers capable of being used for the reactive fiber component described herein include polymer fibers comprised of a polyamide (e.g., nylons), polyesters, polypropylene, or other stretchable, generally non-elastic polymer fibers capable of being extruded, from a spinneret for example. In examples, the particular type of polymer fiber selected for use with embodiments of the reactive fiber components may by hydrophobic rather than hydrophilic. As used herein hydrophobic polymer fibers are generally antagonistic to water and are generally incapable of dissolving in water. Examples of hydrophobic polymer fibers include polyester fibers and polypropylene fibers for example. Examples of polymer fibers that are generally not hydrophobic include nylon fibers.

Operation of modern fiber producing equipment typically operates to draw out (stretch) the initial fibers produced by the spinneret to increase the tenacity of the fibers. In general, the drawing out of polymer fiber causes the molecules in the polymer fiber to become more longitudinally aligned (more oriented), which increases the tenacity of the fiber. However, in example embodiments of the described securing device, the reactive fiber component may be comprised of synthetic polymer fiber that has not been drawn out (stretched) after generation by the spinneret (e.g., the molecules in the fiber remain substantially unoriented).

As used herein, such polymer fibers in a state prior to being drawn out are called undrawn polymer fibers. The initial form of the described securing devices (prior to use) comprises at least one reactive fiber component including undrawn polymer fibers. The stretching of the securing device (during use) causes the undrawn polymer fibers to stretch, which stretching dissipates energy in the load that is causing the securing device to stretch. Undrawn fibers usable as the reactive fiber component in the example embodiments of the securing device may have a range of elongation without recovery, primarily in the range of as much as 150 percent to 3,000 percent or more.

Example embodiments of the securing device may also be comprised of reactive fiber components which are substantially undrawn (e.g., partially drawn out). Further, other alternative embodiments may be comprised of reactive fiber components which have both undrawn polymer fibers and substantially undrawn polymer fibers. As used herein, undrawn polymer fibers are polymer fibers that have not been drawn out in length after or during their initial extrusion. In addition, as used herein, substantially undrawn polymer fibers are polymer fibers that are capable of elongation without recovery greater than commercially available POY yarn. In an example, substantially undrawn polymer fibers correspond to fibers that are capable of elongation without recovery of at least 225 percent. In example embodiments described herein, the reactive fiber components include at least one of: an undrawn, hydrophobic polymer fiber and a substantially undrawn hydrophobic polymer fiber. Such reactive fiber components may be capable of stretching without recovery 300 percent (e.g. three times its initial length). In further alternative embodiments, reactive fiber components may be capable of stretching without recovery 600 percent or more.

Also, in further alternative embodiments, the securing device may be comprised of a plurality of different reactive fiber components, each having different resistive characteristics, lengths, diameters, weaves, and/or functions to achieve different rates of energy dissipation according to the requirements of the application.

In an example embodiment, the securing device 100 may also be comprised of one or more components in addition to the at least one described reactive fiber component 102 comprised of an undrawn fiber or substantially undrawn fiber. For example, an additional component may include at least one first initiating fiber component 104 which will initiate the energy absorption process. Such an initiating fiber component may be designed to break under a predetermined load before it allows the reactive fiber component to stretch a substantial amount. For applications such as a mooring loop, the initiating fiber may be adapted to break under a relatively large amount of force and thereby permit the reactive fiber component to stretch and safely release potential energy in an attached mooring line. However, in other applications, an initiating fiber may be used which is adapted to break under a relatively smaller amount of force to serve primarily to hold the securing device together and prevent premature stretching during assembly or storage.

In example embodiments, an additional component may include at least one terminating fiber component 106, which takes over the load after a predetermined length of elongation of the securing device. For applications such as a safety rope or lanyard, the terminating fiber component may be adapted to dissipate the remaining kinetic energy in the load to a zero point so as to bring a falling object or person to a stop and/or to secure the object or person after being stopped.

In example embodiments, the initiating fiber component and the terminating fiber component may be comprised of synthetic polymers that have high tenacity. As a result, the ability of these additional components to stretch may be substantially less than that of the reactive fiber component. In example embodiments, the terminating fiber component may be comprised of a high tenacity polyester or para-aramid (e.g., Kevlar) or other high tenacity polymer capable of stopping a load on the securing device after a certain amount of elongation of the securing device. Also in example embodiments, the initiating fiber may be comprised of a polymer such as a polyester, polyethylene or another polymer capable of serving as a fuse that breaks with a predetermined amount of load to enable the securing device to begin elongation.

The terminating fiber component (and/or other fiber components) of the securing device may be assembled in a plurality of different ways, such as: in a configuration with overlapping compacted layers, coils, or folds; or in a configuration with a compressed weave. With these described configurations, the terminating fiber component (and/or other fiber components) is enabled to uncompress, uncoil, and/or unfold, without stretching and without substantial energy absorption and dissipation until a predetermined length of the securing device is reached (e.g., until layers of the weave for the respective component become orientated more longitudinally or the compacted layers of the component fully uncoil or unfold). Thus the terminating fiber component (and/or other fiber components) of the securing device may elongate (without stretching) while simultaneously the other fiber components (such as a reactive fiber component) stretches.

When the component that is stretching reaches a breaking point, one or more of the other components may be configured to reach their maximum elongation length (without stretching) as well. If the component reaching its maximum elongation length (without stretching) corresponds to a terminating fiber component, it may have sufficient tenacity to stop the securing device from further elongation or secure the securing device after a full stop.

However, if the component reaching its maximum elongation length without stretching corresponds to another reactive fiber component, it may then begin stretching to take over energy dissipation. Thus a securing device may be capable of using multiple reactive fiber components, which initiate stretching in stages at different predetermined elongation points of the securing device. Such a multi-stage securing device may enable the securing device to carry out energy dissipation over a greater length than a securing device with only one reactive fiber component. Also each stage may be comprised of reactive fiber components with different force resisting properties. For example, each subsequent stage may include a reactive fiber component with progressively greater resistance to stretching so as to achieve progressively greater levels of deceleration of the object or person causing the securing device to elongate.

To form compacted layers of a terminating fiber component (and/or other fiber components) using a braid weave, the weave pattern of the fibers may orientate the fibers to extend in directions closer to being perpendicular to rather than parallel to the longitudinal direction of the securing device. As the securing device elongates, the directions of the fibers in the weave may pivot to extend closer to being parallel to the longitudinal direction. During elongation, the outer diameter of the braided component may also decrease in size.

Compacted components that are not braided may be formed by orientating the component in a compressed arrangement, such as by having it oriented in a coil and/or a folded configuration. Elongation of the securing device causes the component to be uncoiled, unwound and/or unfolded.

To prevent the one or more components of the securing device from binding or becoming tangled as the securing device stretches, an example embodiment of the securing device 100 may include a filler component 108 running the length of the initial (non-elongated) form of the securing device to separate one or more of the components of the securing device. Such a filler component may be comprised of a polyethylene foam or other relatively lightweight and flexible material that is capable of reserving interior space of the securing device prior to use of the device, yet which is a material that upon elongation of the device, breaks apart in a manner that does not interfere with the elongation of the other components of the securing device.

FIGS. 1-33 show various example embodiments for securing devices and/or example configurations of components that may be integrated into a securing device for use in more complex securing devices and apparatuses that employ securing devices. Thus, although each of the examples shown in FIGS. 1-33 is referred to herein as a securing device, it is to be understood that each of the examples shown in FIGS. 1-33 may also correspond to a securing device material or component for use in constructing a more complex securing device.

Figure 1:
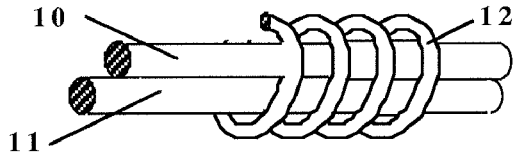
FIGS. 1-33 show example embodiments of securing devices and/or example configurations of a securing device that may be formed into more complex securing devices and apparatuses that employ the securing devices.

With reference to FIG. 1, there is illustrated an example of a securing device in the form of a yarn comprised of three components including an initiating fiber component 10, a reactive fiber component 11, and a terminating fiber component 12. Each of these fiber components may be comprised of a plurality of strands manufactured using a textile process which assembles groupings of polymer fiber strands. As illustrated in FIG. 1, the terminating fiber component in this example may be wrapped around the other two fiber components. It will also be understood that this securing device may include more than one type of each fiber. It will also be appreciated that any combination of yarns and/or strands in the yarns can be mixed and matched in order to achieve a specific result. The particular yarn illustrated in FIG. 1 may be used for either a woven or knit fabric, for example.

Figure 2:
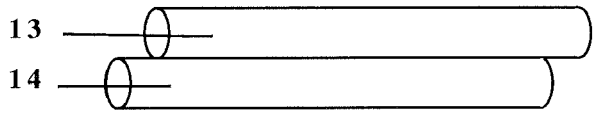

FIG. 2 illustrates another construction of an example securing device in the form of a yarn. Here the yarn is made from an initiating fiber component 13 and a reactive fiber component 14. The yarn shown in FIG. 2 may be used as a primary building block for constructing more complex securing devices.

Figure 3:
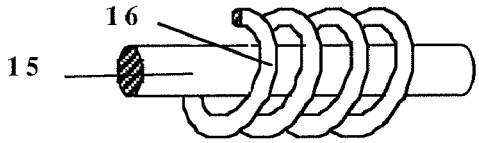

FIG. 3 is similar to FIG. 2 in that it represents a primary building block yarn for creating more complex securing devices. In this example embodiment, the yarn includes a reactive fiber component 15 that is wrapped with a terminating fiber component 16.

As used herein, components such as the reactive fiber component, terminating fiber component and initiating fiber component may have a form that corresponds to one or more fibers, strands, yarns and/or another building block capable of being braided, woven, stitched or otherwise integrated into a securing device.

Figure 4:
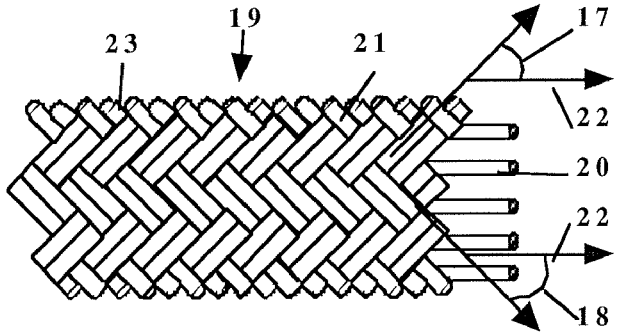

FIG. 4 is a side view of an example securing device 19 for use in a lanyard. Here the securing device includes a terminating fiber component 23 in the form of a plurality of yarns braided in a standard basket weave to form an outside jacket 21. In addition, in this example embodiment the securing device may include a reactive fiber component 20 in the form of a plurality of warp yarns that run parallel within the braid of the jacket 21.

Figure 5:
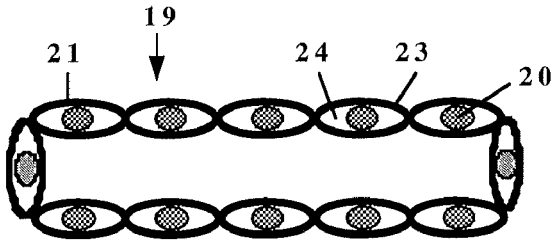

FIG. 5 is an axial view of the securing device 19 showing terminating fiber component yarns 23 of the jacket 21 braided around the reactive fiber component yarns 20. As illustrated in FIG. 5, the jacket 21 may be constructed so as to include sufficient space 24 adjacent the reactive fiber component yarns 20 to permit the reactive fiber component yarns 20 to stretch with minimal resistance from the terminating fiber component yarns 23 of the jacket 21.

Figure 6:
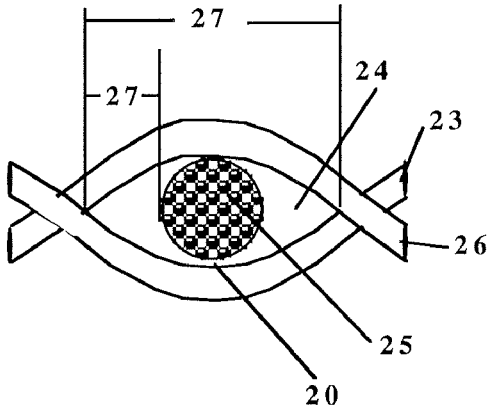

FIG. 6 is a blowup of FIG. 5 showing a reactive fiber component yarn 20 having the terminating fiber component yarn 23 braided thereabout, and showing the spacing or construction allowance 24 therebetween. FIG. 6 also illustrates that the reactive fiber component yarn 20 is itself made up of multiple reactive fiber component strands 25. Also, FIG. 6 illustrates that the terminating fiber component yarn 23 is itself made up of multiple terminating fiber component strands 26. Numeral 27 illustrates the space or construction allowance between the reactive fiber component yarn 20 and the terminating fiber component yarn 23.

As shown in FIG. 4 in an example embodiment, the terminating yarns are braided in directions that extend at large angles 17, 18 (e.g., between 30 and 90 degrees) relative to the longitudinal axis 22 of the securing device 19. As the securing device elongates, the braid ends move or pivot to decrease the angles 17, 18 so as to be closer to parallel relative the longitudinal axis 22. The terminating fiber component yarns generally become as straight as possible given the mechanical properties of the weave. Also as the securing device elongates, the terminating fiber component yarns constrict the space 24 around the reactive fiber component yarn 20. Thus example embodiments of the securing device as shown in FIG. 6 may be constructed to provide space 24 around the reactive fiber component yarn 20 so as to allow sufficient room for the reactive fiber component yarn to stretch a required amount before the jacket 19 or terminating fiber component yarn 23 pinches it. The size of the space 24 may vary based upon the types of reactive fiber components used, the type of textile (such as rope versus woven fabric), and the distance to total elongation required.

Figure 7:
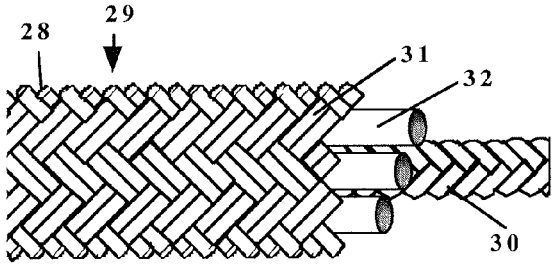

FIG. 7 shows a cutaway of an example securing device 29 in the form of a double braided rope comprised of three different components: a reactive fiber component yarn 30; a terminating fiber component yarn 31; and a filler component 32. The terminating fiber component yarn 31 may be braided into a hollow jacket 28. The filler component 32 may be comprised of a foam which serves to reserve the previously described space or construction allowance between the reactive fiber component yarns 30 and the terminating fiber component yarns 31. The filler component 32 may be fed into the braiding machine at the same time as when the jacket is braided around the terminating fiber component yarn 30. The filler material 32 adds volume to the core of the jacket 29, which makes the inner diameter of the jacket substantially larger than the outer diameter of the reactive fiber component yarn 30. The filler component 32 can be any material that does not appreciably affect the mechanics of elongation of the securing device. Hence, a material such as a foam or another material that destructs easily and does not interfere with the other components of the securing device may be used for the filler component 32.

Figure 8:
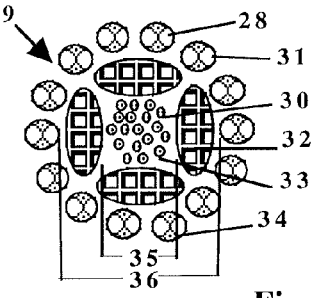

FIG. 8 is a cross section of the securing device 29 shown in FIG. 7. FIG. 8 illustrates that the reactive fiber component yarns 30 may be comprised of strands 33 of reactive fiber components. Also, FIG. 8 illustrates that the terminating fiber component yarns 31 may be comprised of strands 34 of terminating fiber components. In this example embodiment, the reactive fiber component yarns 30 may be braided as well.

FIG. 8 also illustrates an example placement of the filler components (e.g., columns of foam) oriented at locations around the reactive fiber component yarns 30 to consume space between the outer diameter 35 of the braided or grouped reactive fiber component yarns 30 and the inner diameter 36 of the jacket 28.

Figure 9:
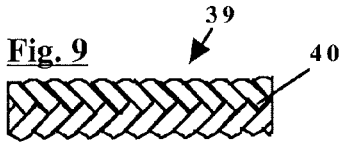
Figure 10:
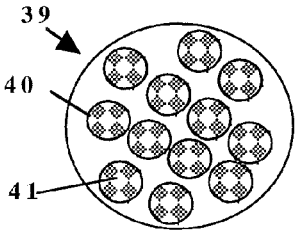
Figure 11:
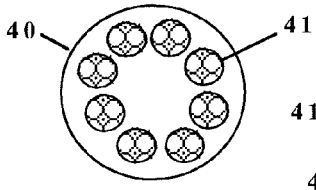
Figure 12:
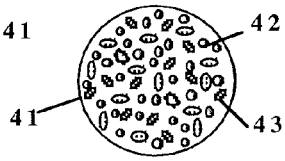

FIG. 9 shows an example of a securing device 39 in the form of a one-part braided rope. FIGS. 10, 11 and 12 show cross-sectional views of the securing device 39. In this example embodiment, each yarn 40 in the braid of the securing device 39 is comprised of many feed yarns 41, which are themselves comprised of many fiber strands 42, 43. In this embodiment, the feed yarn 41 may be a combination of reactive fiber component strands 42 and initiating fiber component strands 43 in one bundle. In this construction, the initiating fiber components may serve as a fuse that breaks at a predetermined point (of elongation and/or force), at which time the reactive fiber components take over and stretch until they break and release.

Figure 13:
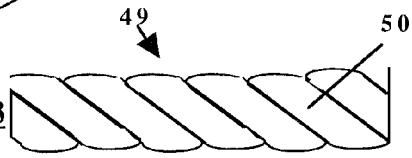
Figure 14:
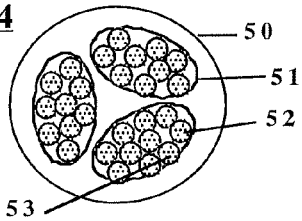
Figure 15:
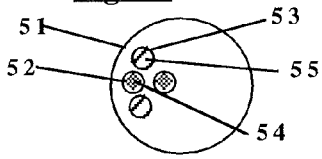

FIG. 13 shows another example embodiment of a securing device 49 in the form of a three-strand rope comprised of composite yarns 50. FIGS. 14 and 15 are cross-sectional views of the securing device 49 of FIG. 13 and illustrate that the composite yarns 50 are formed by a single lay 51 of both reactive fiber component yarns 52 and initiating fiber component yarns 53.

FIG. 15 illustrates that each reactive fiber component yarn 52 is comprised of reactive fiber components strands 54. Also, each initiating fiber component yarn 53 is comprised of initiating fiber component strands 55.

Figure 16:
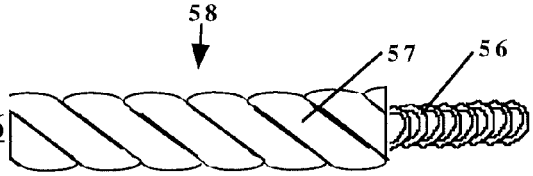

FIG. 16 shows an example embodiment of the securing device 58 in the form of a three-strand rope. Here a reactive fiber component is used to form the outside lay 57 of the securing device. The center of the securing device includes a terminating fiber component yarn 56 which takes on a coiled configuration. This compressed coiled configuration of the terminating fiber component yarn 56 is capable of uncoiling and expanding as the outside lay 57 (comprised of the reactive fiber component) stretches. In this embodiment, elongation of the securing device 58 will stop at the point when the terminating fiber component yarn 56 becomes fully uncoiled.

Figure 17:
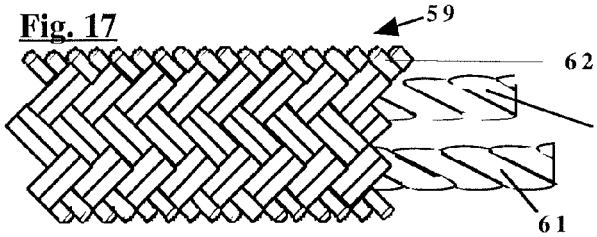
Figure 18:
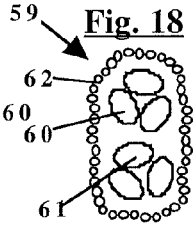

FIGS. 17 and 18 show an example embodiment of a securing device 59 in a form in which a braided jacket 62 is comprised of a terminating fiber component that is braided around two ropes (one rope 61 made of an initiating fiber component and one rope 60 made of a reactive fiber component). In this embodiment, the rope 61 comprised of an initiating fiber component serves as a fuse which breaks when a predetermined amount of force is applied. The breaking of the rope 61 permits the rope 60 comprised of the reactive fiber component to stretch and to enable the securing device 59 to elongate. During elongation of the securing device 59 (and stretching of the rope 60), the outer jacket expands. When the outer jacket becomes fully expanded it stops the elongation of the securing device (and stretching of the rope 60).

Figure 19:
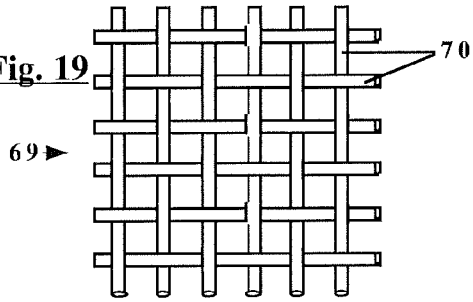
Figure 21:
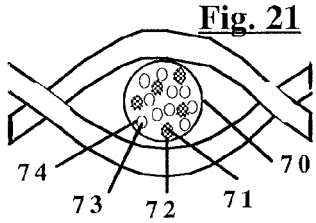
Figure 20:
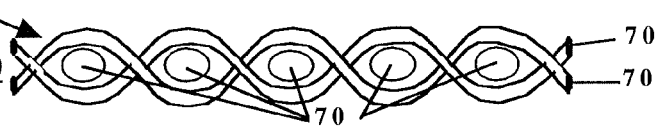

FIGS. 19 through 21 illustrate an example embodiment of a securing device 69 in the form of a woven fabric which is made from a composite yarn 70. As shown in FIG. 21 the composite yarn 70 is comprised of two types of yarn: a reactive fiber component yarn 72 comprised of reactive fiber component strands 71; and initiating fiber component yarns 74 comprised of initiating fiber component strands 73.

Figure 22:
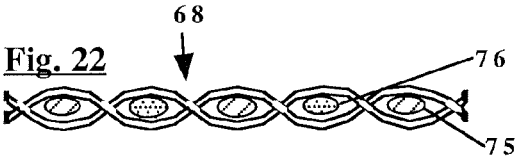
Figure 23:
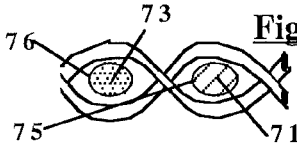

FIGS. 22 and 23 illustrate an example embodiment of a securing device 68 in the form of a woven fabric which is made from alternating different types of yarn instead of a composite yarn as shown in FIGS. 19-21. As shown in FIGS. 22 and 23 the alternating different types of yarn include the following: a reactive fiber component yarn 75 comprised of reactive fiber component strands 71 and an initiating fiber component yarn 76 comprised of initiating fiber component strands 73.

Figure 24:
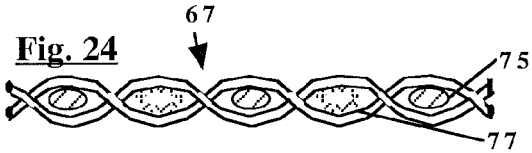
Figure 25:
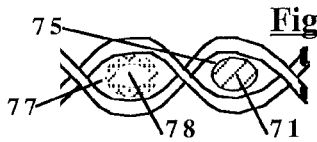

FIGS. 24 and 25 illustrate another example embodiment of a securing device 67 in the form of a woven fabric which is made from alternating different types of yarn. Here the alternating different types of yarn include the following: a reactive fiber component yarn 75 comprised of reactive fiber component strands 71 and a terminating fiber component yarn 77 comprised of terminating fiber component strands 78.

Figure 26:
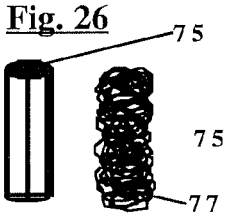
Figure 27:
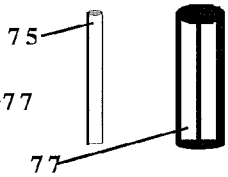

FIGS. 26 and 27 illustrate the securing device 67 in different states. FIG. 26 shows a portion of the securing device prior to use in an unelongated state. Here the reactive fiber component 75 is shown unstretched and the terminating fiber component 77 is shown coiled and/or compressed. FIG. 27 shows a portion of the securing device after a force has been applied which elongates the device to its maximum length. Here the reactive fiber component 75 is shown after being stretched and the terminating fiber component 77 is shown uncoiled.

Figure 28:
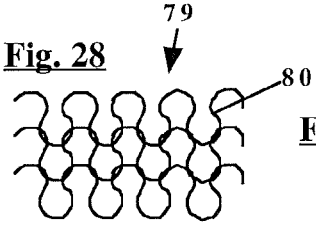
Figure 29:
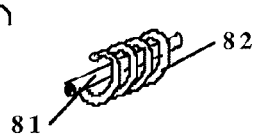

FIGS. 28 and 29 illustrate another example embodiment of a securing device 79 in the form of a knit fabric which is made from a composite yarn 80. As shown in FIG. 29 the composite yarn 80 is comprised of a terminating fiber component 82 that is wrapped around a reactive fiber component 81.

Figure 30:
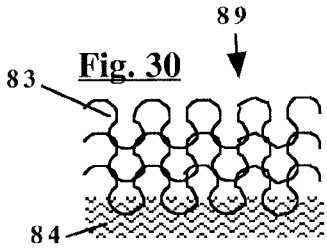
Figure 31:
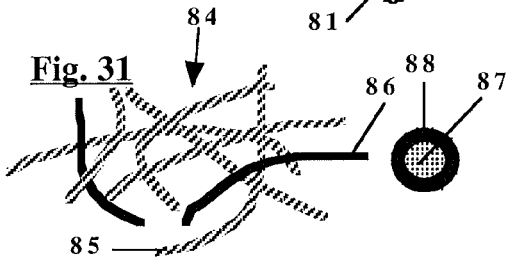

FIGS. 30 and 31 illustrate another example embodiment of a securing device 89 in the form of a stitched bonded fabric made by knitting or stitching a terminating fiber component yarn 83 into a non-woven fabric 84. As shown in FIG. 31, the non-woven fabric may be comprised of a reactive fiber component yarn 85. Also the non-woven fabric may be comprised of a bi-component binder fiber 86 comprised of a high melt polymer 87 and a low melt polymer 88. Here the inner core of the bi-component binder fiber 83 may be formed from the high melt polymer 87, and the outside jacket of the bi-component binder fiber 83 may be formed with the low melt polymer 88. The two reactive fiber components, yarn 85 and the bi-component binder fiber 86, may be blended together and run through a heated colander which causes the low melt polymer to melt and combine the entire mass together.

The final form of this example embodiment of a securing device 89 may be a flat fabric capable of stretching. Stretching of the fabric causes the knit of the terminating fiber component to stretch and lengthen. The fabric will stop stretching once the terminating fiber component has reached its maximum nit fabric stretch.

Figure 32:
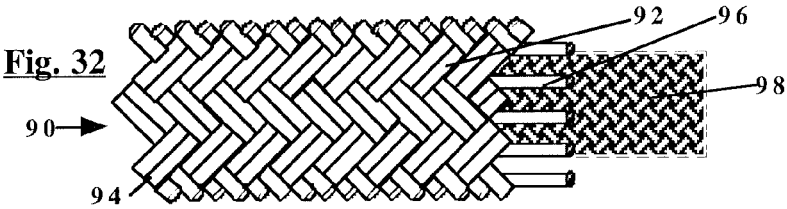
Figure 33:
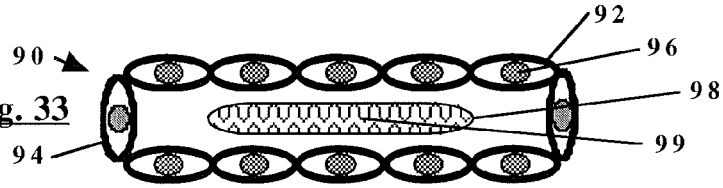

FIG. 32 is a side view of an example securing device 90. Here the securing device includes an outside jacket 92 comprised of a plurality of terminating fiber component yarns 94 braided in a standard basket weave. In this example embodiment the securing device may include a plurality of spaced-apart initiating fiber component yarns 96 in the form of warp yarns that run parallel within the braid of the jacket 92. As shown in FIG. 33 within the core of the jacket, the securing device 90 may include a reactive fiber component 98 comprised of a flat braid of reactive fiber component yarns 99.

In this example embodiment of the securing device, the initiating fiber component yarns 96 may be bonded to the terminating fiber yarns 94 in the jacket 92 to keep the securing device together in a compressed and stable form. When being used to stop a falling object or person the initial force of the falling object or person will cause the initiating fibers to break, which frees the jacket to expand and the reactive fiber component 98 to stretch. Stretching of the reactive fiber component 98 dissipates kinetic energy in the object and person. Then upon reaching maximum expansion of the jacket, the jacket will bring the object and person to a full stop.

EXAMPLE 1

A test example of the securing device 19 shown in FIG. 4 was made. For this test example, the reactive fiber component yarns 20 were formed from 13 ends, 1727 denier polyester with a reactive elongation factor greater than 8.5 reactive elongation, wound parallel. Also in this test example, the outside jacket (the terminating fiber component 21) was formed with 10 ends, 1000 denier high tenacity polyester with 0 percent reactive elongation, twisted 1.25 turns per inch, 2 yarns per bobbin braided with a construction ratio of greater than 1.1, 24 carrier maypole braid. The resulting securing device was tested against a weight of 220 pounds falling 72 inches. From an initial length of 74.25 inches, the securing device elongated a total of 41.5 inches to stop the fall of the test weight.

EXAMPLE 2

A test example of the securing device 29 shown in FIG. 7 was made. For this test example, the reactive fiber component yarn 30 was formed from 65 ends, 1727 denier polyester with a reactive elongation factor greater than 8.5 reactive elongation, twisted 1.25 turns per inch, 1 yarn per bobbin, braid angle at 45 degrees, and at 24 carrier maypole braid. The terminating fiber component yarn 31 was formed from 30 ends, 1000 denier high tenacity polyester with 0 reactive elongation, twisted 1.25 turns per inch, having 1 yarn per bobbin and having a construction ratio greater than 1.1 and 16 carrier maypole braid. The filler component 32 comprised 4 ends, ⅜ inch polyethylene foam backer rod. This example of the securing device was tested with a test weight of 220 pounds, falling a distance of 6 feet. From an initial length of 73.76 inches, the securing device experienced a total elongation of 34.25 inches to stop the fall of the test weight.

EXAMPLE 3

A test example of a securing device with a constructions similar to the securing device 89 shown in FIG. 32 was made. For this test example, the reactive fiber component 98 was comprised of an un-oriented (undrawn) polypropylene yarn of 3430 denier manufactured by FIT fiber in Johnson City, Tenn. The reactive fiber component 98 was pre-assembled into a core yarn comprised of a total denier of 226,380 in a 66 carrier flat braid. Pick count yielded a tight braid of about 45 degrees braid angle producing a reactive fiber component 98 for use as a core yarn with an approximate width of 1.5 inches.

Also in this test example the outside jacket 92 (comprising the terminating fiber component yarns 94) was comprised of a para-aramid under the trademark Kevlar, manufactured by E.I DuPont de Nemours & Co. in Richmond, Va. The weave of the terminating fiber component yarns 94 was constructed with one end of 3000 denier type 29 Kevlar.

The initiating fiber component yarn 96 corresponded to a composite initiating fiber component yarn constructed with: four ends of a 300 denier, parallel wound bi-component sheath core yarn; and four ends of the 3430 denier un-oriented polypropylene discussed previously. The bi-component sheath core yarn was comprised of a polyester core with a melt point of 480 degrees Fahrenheit and a polyethylene jacket with a melt point of 107 degrees Fahrenheit manufactured by FIT Fibers of Johnson City, Tenn.

During construction of the jacket 92 the composite initiating fiber component yarns 96 were fed under constant tension into 12 warp tubes fitted to a Ratera, 24 carrier, 140 millimeter maypole braider. The preassembled core yarn comprising reactive fiber component 98 was fed under constant tension into the center of the braid of the jacket. The terminating fiber component yarn 94 of the jacket 92 was braided over the core yarn and around the warp yarns comprising the composite initiating fiber component yarns 96. Each of the 24 bobbins included a single end of the terminating fiber component yarns 94.

A modified braiding dye was utilized to form then outer jacket 92 with an inner diameter of 1.5 inches. The dye was designed to make each successive lay of the terminating fiber component yarn 94 advance. The takeoff of the braider was modified to accommodate flat structures and was equipped with a pair of hot rollers that belted the outer sheath of the initiating fiber component yarns 96 and bond them to the jacket 92, stabilizing the final product for additional processing into a finished unit.

Figure 35:
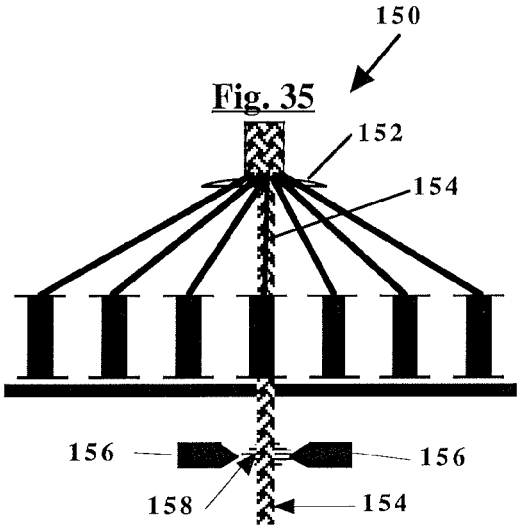
FIG. 35 shows an example configuration of a braiding machine for use with producing an example securing device.

In this example and/or other examples in which a jacket is braided around a reactive fiber component core, an adhesive may be applied to the reactive fiber component prior to entering the braiding die. FIG. 35 depicts an example of a braider 150 that is configured to braid a terminating fiber jacket on a modified braiding dye 152 around a reactive fiber core 154. In this example, spray devices 156 may be positioned to coat the outside of the reactive fiber core 154 with an adhesive 158 as the core enters the braider 150. The adhesive used in this example may include an adhesive capable of holding the jacket in place along the core and prevent premature elongation of the terminating fiber jacket. However, the adhesive must also be capable of having its adhesive bond between the jacket and core break under a predetermined amount of force to permit elongation of the jacket and core. For example in the case of a lanyard, an adhesive may be used that will enable an adhesive bond between the jacket and core to break in response to the initial forces of a falling person. An example of an adhesive that may be used in a lanyard application includes Simalfa X357, which is a water born adhesive that is a dispersion of acrylic resin and synthetic rubber in water supplied by Alfa Adhesives, Inc. located at 15 Lincoln Street, Hawthorne, N.J. 07506.

Figure 36:
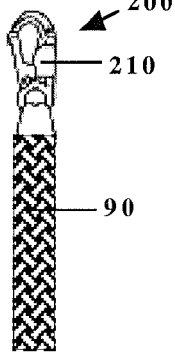
FIGS. 36-49 show examples of apparatuses that employ examples of the securing devices.
Figure 37:
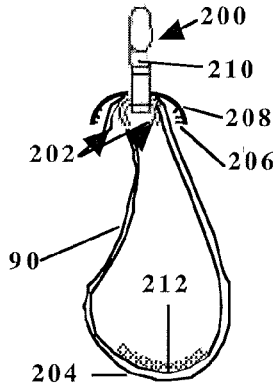

The previous examples of the securing device may be used in a plurality of different types of apparatuses for use with securing people, boats or other objects. For example the securing device 90 depicted in FIG. 32 may be integrated into a safety loop 200 as shown in FIG. 36. Such a loop may include a loop comprised of the example securing device 90 connected to a hook 210 via a fastener 208. FIG. 37 shows a side view of the safety loop 200 prior to the fastener 208 being clamped or crimped down holding opposed ends 202 of the securing device 90 together to the hook. The fastener 208 may include teeth 206 for example, that become imbedded in the securing device 90 to hold the safety loop together. An end 204 of the safety loop opposed of the hook 210 may also include reinforcement material 212 to minimize damage to the safety loop at the location the safety loop is connected to an anchor point, another hook, or other support. In addition the securing device 90 may be coated with a colorant (e.g., yellow) for safety recognition and/or other material for abrasion protection.

Figure 39:
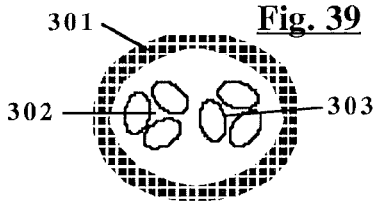
Figure 38:
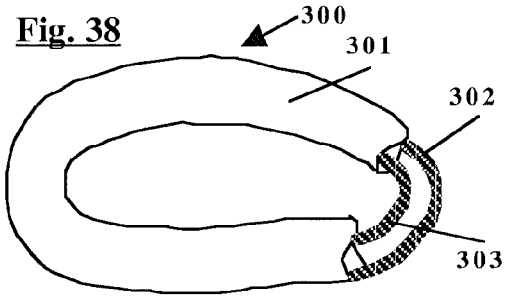
Figure 40:
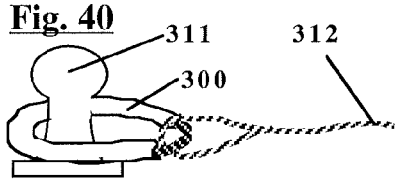

FIGS. 38-44 show further examples of apparatuses that use one or more of the previous described securing devices. For example FIG. 38 depicts a mooring loop 300 comprised of a securing device configured for use with mounting a mooring line 312 to a mooring bollard 311 as shown in FIG. 40. In use the mooring loop 300 may correspond to a fuse that provides elongation at a predetermined amount of force to minimize breaking of a mooring line which could lash backward with excessive force.

FIG. 39 shows a cross-sectional view of the mooring loop 300. In this example the mooring loop is comprised of an anti-lashback jacket 301 that encases portions of a continuous loop of an initiating fiber component 302 and a reactive fiber component 303. The initiating fiber component 302 may be in the form of a three strand rope with ends spliced together into a continuous loop. The reactive fiber component 303 may also be in the form of a three strand rope with ends spliced together into a continuous loop. In this example the anti-lashback jacket 301 may be comprised of a woven nylon or other material capable of encasing the initiating fiber component and reactive fiber component. When the initiating fiber breaks, the anti-lashback jacket 301 contains the broken initiating fibers and prevents injury or damage from occurring to adjacent people or objects. The reactive fibers may then stretch to relieve forces in a mooring line 312.

Figure 41:
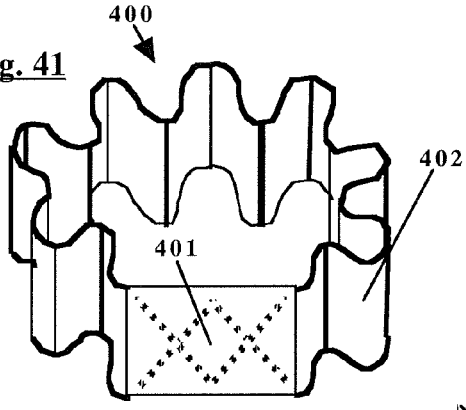
Figure 42:
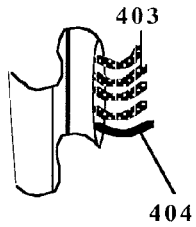
Figure 43:
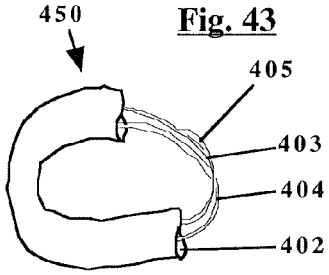

FIG. 41 depicts an example of a rope fuse 400 comprising an example securing device. The rope fuse is comprised of a gathered or compressed woven tube 402 that is secured to itself at 401 to form a continuous loop. As shown in FIG. 42, the woven tube may encase a plurality of strands/yarns of reactive fiber component 403 and one or more strands/yarns of an initiating fiber component 404. FIG. 43 shows an interior cross-section 450 of the rope fuse 400. As with the previously described mooring loop, the reactive fiber component(s) 403 and the initiating fiber component(s) 404 may have ends spliced together to form continuous loops 405. In this example, when the initiating fiber component breaks in response to a predetermined amount of force, the reactive fiber component may elongate while the gathered woven tube un-gathers into a fully expanded tube. Elongation of the reactive fiber component is operative to slow the object applying the force to the rope fuse. When the woven tube reaches its fully expanded configuration, it is operative to stop further elongation of the rope fuse.

Figure 44:
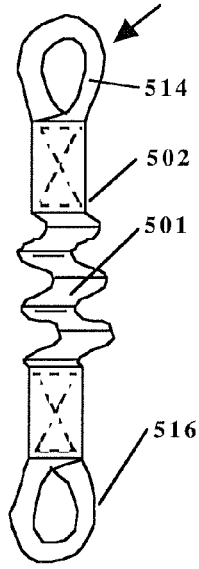
Figure 45:
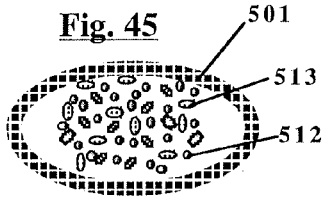

FIG. 44 depicts an alternative example of a safety lanyard 500 comprising an example securing device 502. Here the lanyard may be comprised of a securing device 502 with hooks 514 and 516 mounted to each end. The securing device may be comprised of a gathered woven tube 501 comprised of a terminating fiber component. As shown in FIG. 45, the gathered woven tube 501 may encase initiating fiber component(s) 512 and reactive fiber component(s) 513 with their ends also secured to the hooks 514, 516. In this example when the initiating fiber component breaks in response to a predetermined amount of force, the reactive fiber component may elongate while the gathered woven tube un-gathers into a fully expanded tube. Elongation of the reactive fiber component is operative to slow the object applying the force to the lanyard. When the woven tube reaches its fully expanded configuration it is operative to stop further elongation of the lanyard.

Figure 47:
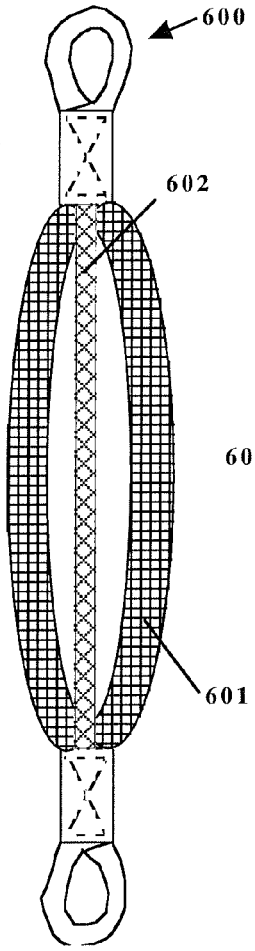
Figure 46:
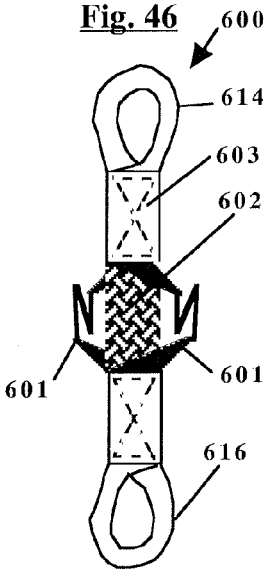
Figure 48:
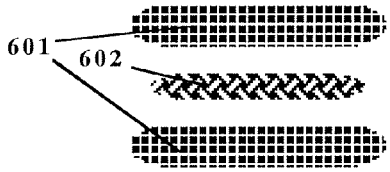

FIG. 46 depicts a further alternative example of a safety lanyard 600 comprising an example securing device 603. Here the lanyard may be comprised of a securing device 602 with hooks 614 and 616 mounted to each end. The securing device may include two parallel woven webs 601 comprised of a terminating fiber component with ends mounted to the hooks 614, 616. The securing device may also include a reactive fiber component 602 with ends mounted to the hooks 614, 616. FIG. 46 depicts the lanyard prior to use with the two woven webs 601 in a gathered folded form and the reactive fiber component 602 prior to elongation. FIG. 47 depicts the lanyard after use with the two woven webs 601 in an unfolded form and the reactive fiber component 602 elongated. FIG. 48 also shows a cross-sectional view of the unfolded form of the lanyard shown in FIG. 47. It is to be understood that FIGS. 46-48 are not drawn to scale. In an example implementation the elongated form of the safety lanyard 600 may be several times the length of the non-elongated form of the safety lanyard.

Figure 49:
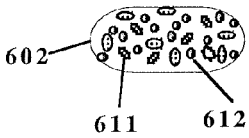

As shown in FIG. 49 the reactive fiber component 602 may be comprised of a reactive fiber component strands/yarns 611 braided into a rope or other form. In addition the lanyard 600 may include initiating fiber component strands/yarns 612 extending though the reactive fiber component rope with end mounts on the hooks 614, 616. In this example when the initiating fiber component breaks in response to a predetermined amount of force, the reactive fiber component may elongate while the two gathered woven webs unfold into a fully expanded form. Elongation of the reactive fiber component is operative to slow the object applying the force to the lanyard. When the two woven webs reach their fully expanded configuration, they are operative to stop further elongation of the lanyard.

Thus the securing device of the example embodiments achieve at least some of the above stated objectives, eliminate difficulties encountered in the use of prior devices and systems, and attain the useful results described herein.

In the foregoing description, certain terms have been described as example embodiments for purposes of brevity, clarity and understanding. However, no unnecessary limitations are to be implied therefrom, because such terms are used for descriptive purposes and are intended to be broadly construed. Moreover, the descriptions and illustrations herein are by way of examples, and the invention is not limited to the features shown or described.

Further, in the following claims any feature described as a means for performing a function shall be construed as encompassing any means known to those skilled in the art as being capable of carrying out the recited function and shall not be deemed limited to the particular means shown or described for performing the recited function in the foregoing description, or mere equivalents thereof.

Having described the features, discoveries and principles of the invention, the manner in which it is constructed and operated, any of the advantages and useful results attained; the new and useful structures, devices, elements, arrangements, parts, combinations, systems, equipment, operations, methods, processes and relationships are set forth in the appended claims.

The invention claimed is:

1. An apparatus comprising:

a securing device including:

a reactive fiber component, wherein the reactive fiber component includes at least one of the following: an undrawn hydrophobic polymer fiber; a substantially undrawn hydrophobic polymer fiber; or any combination thereof, wherein the reactive fiber component is operative to stretch responsive to a load; and at least one of the following:

a terminating fiber component, wherein the terminating fiber component is in a compressed state and is operative to elongate to a length at which the terminating fiber component is operative to prevent further stretching of the reactive fiber component responsive to the load;

an initiating fiber component, wherein the initiating fiber component is operative to break and permit the reactive fiber component to stretch responsive to the load;

or any combination thereof.

2. The apparatus according to claim 1, wherein the securing device comprises both the terminating fiber component and the initiating fiber component.

3. The apparatus according to claim 2, wherein the apparatus corresponds to a lanyard, wherein further comprising at least one hook, wherein at least one end of the securing device is mounted to the at least one hook.

4. The apparatus according to claim 3, further comprising two hooks, wherein the securing device includes two gathered woven webs comprised of the terminating fiber component, wherein the opposed ends of the two gathered woven webs are mounted to the hooks, wherein opposed ends of the reactive fiber component and the initiating fiber component are mounted to the hooks.

5. The apparatus according to claim 1, wherein the reactive fiber component is in a form of a braided rope.

6. The apparatus according to claim 5, comprising the terminating fiber component, wherein the terminating fiber component is in a form of a woven jacket that extends around the braided rope.

7. The apparatus according to claim 6, further comprising an adhesive bonding at least portions of the woven jacket to the braided rope.

8. The apparatus according to claim 6, wherein the securing device further includes a filler component extending within the woven jacket between the reactive fiber component and the terminating fiber component.

9. The apparatus according to claim 8, wherein the filler component comprises a foam.

10. The apparatus according to claim 1, wherein the reactive fiber component comprises a polypropylene.

11. The apparatus according to claim 1, comprising the terminating fiber component, wherein the terminating fiber component comprises a para-aramid.

12. The apparatus according to claim 1, comprising the initiating fiber component, wherein the initiating fiber component comprises a polyester.

13. The apparatus according to claim 1, wherein the reactive fiber component is operative to elongate without recovery at least 225%.

14. A method comprising:

braiding strands of a reactive fiber component, wherein the reactive fiber component includes at least one of the following:

an undrawn hydrophobic polymer fiber; a substantially undrawn hydrophobic polymer fiber; or any combination thereof, wherein the reactive fiber component is operative to stretch responsive to a load;

forming a braided jacket around the reactive fiber component, wherein the braided jacket is comprised of a terminating fiber component, wherein the terminating fiber component is in a compressed state and is operative to elongate to a length at which the terminating fiber component is operative to minimize further stretching of the reactive fiber component responsive to the load.

15. The method according to claim 14 wherein forming the braided jacket includes forming the braided jacket with an initiating fiber component therein, wherein the initiating fiber component is operative to break and permit the reactive fiber component to stretch responsive to the load.

16. The method according to claim 14, wherein forming the braided jacket includes forming the braided jacket with a filler component between the jacket and the reactive fiber component, wherein the filler component is operative to break apart responsive to elongation of the braided jacket.

17. The method according to claim 14, further comprising applying an adhesive to the reactive fiber component prior to forming the braided jacket around the reactive fiber component.

18. The apparatus according to claim 1, comprising the terminating fiber component.

19. An apparatus comprising:

a plurality of yarns including:

a reactive fiber component, wherein the reactive fiber component includes at least one of the following: an undrawn hydrophobic polymer fiber; a substantially undrawn hydrophobic polymer fiber; or any combination thereof, wherein the reactive fiber component is operative to stretch responsive to a load; and a terminating fiber component, wherein the terminating fiber component is in a compacted configuration and is operative to elongate responsive to the load to a length at which the terminating fiber component is operative to minimize further stretching of at least portions of the reactive fiber component responsive to the load;

wherein the yarns are combined into a fabric.

20. The apparatus according to claim 19, wherein the fabric is comprised of a composite yarn made of the terminating fiber component wrapped around the reactive fiber component.

* * * * *